United States Patent [19]

Yarnold

[11] Patent Number: 4,535,922

[45] Date of Patent: Aug. 20, 1985

[54] TRAP STAND CARRIER

[76] Inventor: Bart M Yarnold, 6425 Reseda Blvd., Reseda, Calif. 91335

[21] Appl. No.: 597,406

[22] Filed: Apr. 5, 1984

[51] Int. Cl.[3] ..... B65D 71/00; G10G 7/00

[52] U.S. Cl. ..... 224/202; 84/453; 206/314; 294/156; 294/168

[58] Field of Search ..... 294/168, 153, 155, 156, 294/147; 224/202, 257, 917, 910, 913, 922; 84/453; 248/441 R; 206/314, 446

[56] References Cited

U.S. PATENT DOCUMENTS

| | | | |
|---|---|---|---|
| 295,030 | 3/1884 | Marot | 294/168 X |
| 424,806 | 4/1890 | Morris | 294/168 X |
| 2,397,433 | 3/1946 | Reeves | 294/156 |
| 2,497,033 | 2/1950 | Morscher | 294/156 |
| 3,481,519 | 12/1969 | Snetselaar | 294/153 X |
| 3,830,416 | 8/1974 | Smedley | 224/917 X |
| 3,877,623 | 4/1975 | Breault | 294/147 |
| 4,103,812 | 8/1978 | Steiner | 294/168 X |
| 4,334,612 | 6/1982 | Beato | 83/453 X |

FOREIGN PATENT DOCUMENTS

| | | | |
|---|---|---|---|
| 2630271 | 1/1978 | Fed. Rep. of Germany | 224/202 |

*Primary Examiner*—Stephen Marcus
*Assistant Examiner*—Robert Petrik
*Attorney, Agent, or Firm*—Charles F. Gunderson

[57] ABSTRACT

A device for carrying elongated, irregularly-shaped objects, such as musical instrument stands, has an elongated main brace with straps, or other means, at either end, for wrapping around and securing the elongated, irregularly-shaped objects to the main brace. An adjustable handle is centrally located and moveable along the main brace to balance the load. Variable extension rods may be provided on either end of the main brace to extend its length and capacity as needed. The straps would be positioned at either end of the main brace, or the extension rods, and between them as needed. A flexible material may extend the length of the main brace to replace the straps, and wrap around, hold, secure, and protect the musical instrument stands.

3 Claims, 9 Drawing Figures

TRAP STAND CARRIER

BACKGROUND OF THE INVENTION

Musicians have many problems associated with moving their equipment to and from various concert situations. This varies considerably with the size and shape of the instrument or instruments and the distance, etc., from their means of transportation to the stage. Some of the equipment can be relatively awkward to carry, aside from its weight. Also the amount of equipment may vary from situation to situation This is particularly true of drummers, who must have a variety of percussion instruments for various performances, and, as a unique problem, a corresponding variety of stands of various sizes and shapes for mounting each separate instrument at the proper height and in a convenient location. For example, there are separate sizes and shapes of stands for cymbals, bongoes, and snare drums, as well as for traps. These stands can be awkward to carry by themselves, and even when folded up do not fit in conventional small hand luggage. Also, to add to the problem, there are usually several stands to carry.

At present, there are few, if any, carrying devices that can readily accomodate all of the different sizes and shapes of the trap and other stands for drummers and other musicians, and there is clearly a need for such a device. It is therefore an object of this invention to provide a device particularly adapted for carrying trap stands and the like. It is a further object of this invention to provide a device that can accomodate several stands of assorted sizes and shapes, and also protect them, to a considerable extent, from weather damage as well as physical damage. It is a further object of this invention to provide a carrier, for a variety of awkward sizes and shapes of stands, that is easy to carry.

SUMMARY OF THE INVENTION

An elongated main brace has a first carrying means, or handle, movably secured near the center of the main brace. It has at least one securing means at each end for wrapping around, and holding, the corresponding ends of elongated equipment, such as folded trap stands, under the main brace to be carried by the handle, which can be moved to the balance point of the load.

Extensions rods may be provided at either end of the main brace. These can be moved in or out of the main brace to accomodate longer or shorter stands. The securing means or straps must include some form of buckle or fastener to secure the load. A cloth or plastic material may also be used as the securing means. This may be long enough to be attached to and extend the length of the main brace. This material must also be wide enough to be wrapped around the stands and over the top of the brace to be secured with "velcro" or the like to hold the stands. This material will further protect the equipment physically and against the elements.

DETAILED DESCRIPTION OF THE DRAWINGS

Figure 1:
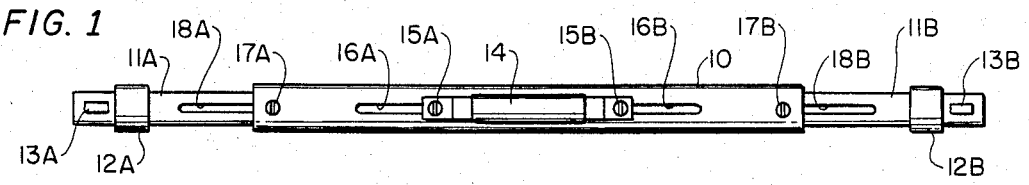
FIG. 1 is a top view of the device.

Referring now more particularly to FIG. 1, a top view is shown of one species of this invention. This includes a main brace 10 with extension rods 11A and 11B supporting straps 12A and 12B. Shoulder strap rings 13A and 13B are shown at each end of the extension rods. A handle 14 is positioned near the center of the main brace, and secured to the main brace by handle bolts 15A and 15B through slots 16A and 16B that permit movement of the handle for balancing of the load. Extension-rod bolts 17A and 17B at the extremities of the main brace secure the extension rods through the extension-rod slots 18A and 18B.

Figure 2:
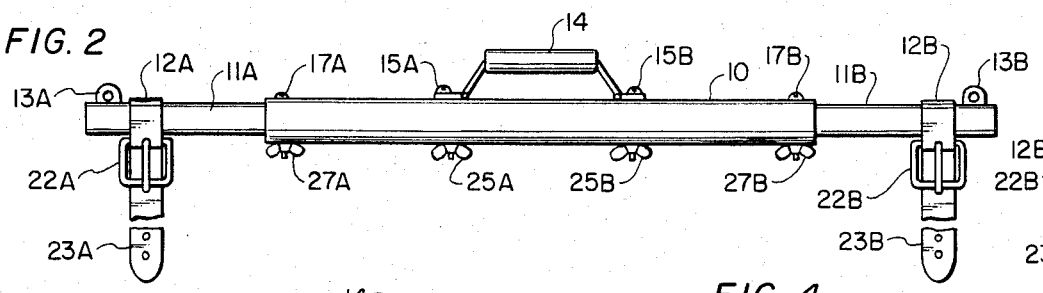
FIG. 2 is a side view of the device.

Much of this will be more clearly seen in the side view of the same species of the device shown in FIG. 2, where similar elements are similarly numbered. This shows, from a different angle, the main brace 10, with its extension rods 11 A & B, and handle 14. This figure also shows typical handle-bolt wing nuts 25A and 25B to secure the handle to the main brace in a movable manner, and extension-rod-bolt wing nuts 27A and 27B for movably securing the extension rods.

This also shows, more clearly, the shoulder-strap rings 13 A & B, and the straps 12 A & B. These may have conventional buckles, such as 22A and 22B on one side and elongated tongues such as 23A and 23B on the other side with conventional holes to accomodate the buckle, as will be seen in use in FIG. 5.

Figure 3:
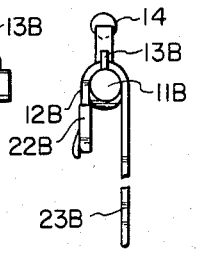
FIG. 3 is an end view of the device.

FIG. 3 is an end view of this species of this device with similar elements similarly numbered. This shows the strap 12B draped over the extension rod 11B with the buckle 22B and elongated tongue 23B ready for use. Actually, the straps should be secured to the rods by any convenient means, to avoid loss and to be ready and in place when needed.

Figure 4:
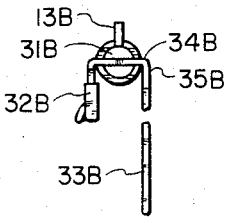
FIG. 4 is an end view of a variation of this device.

FIG. 4 is another end view of a slight variation of the basic carrier, with corresponding elements similarly numbered. Here the extension rod 31B has a slot 34B to hold the strap 35B. This allows more flexibility in the placement of the shoulder-strap ring 13B. The buckle 32B and tongue 33B may be the same and have the same function as their counterparts in FIGS. 1–3.

Figure 5:
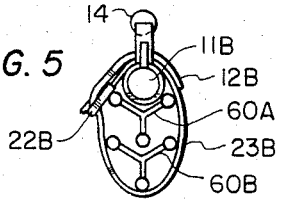
FIG. 5 is an end view of the device in use.

FIG. 5 is an end view of the foregoing species of this device in use, with, again, similar elements similarly numbered. This figure shows two typical stands 60A and 60B with their tripod legs folded, and held under the main brace and its extensions rod 11B. The tongue 23B of the strap 12B is secured by the buckle 22B in a well known manner to hold the ends of the stands.

Figure 6:
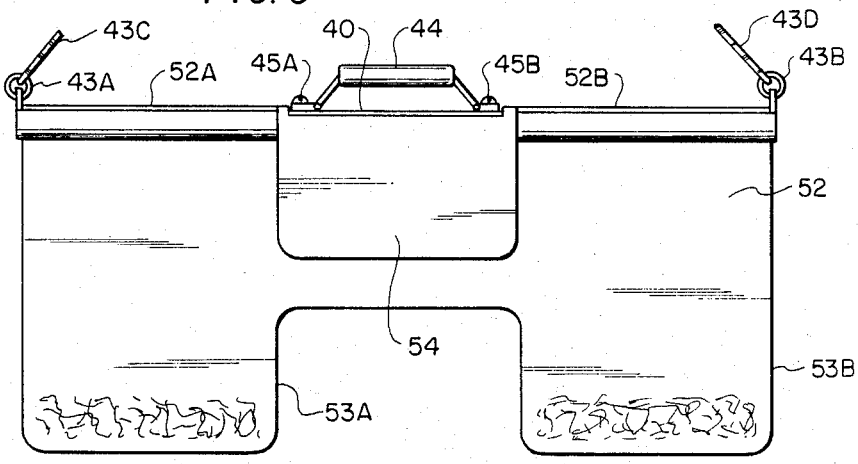
FIG. 6 is a side view of another species of this device.

FIG. 6 is a side view of another species of this invention. Here a solid main brace 40 has a centrally-located handle 44 secured to the main brace by handle bolts 45A and 45B, which may be through slots, not shown, as before, for the same purpose. The lower portins 43C and 43D of the optional, but very-advisable shoulder straps are shown in this figure attached to shoulder-strap hooks or rings 43A and 43B.

The main variation here is in the use of a solid, flexible material 52 extending the length of the main brace on either side of the handle as 52A and 52B, to wrap around, support, and protect equipment being carried. The material 52 would, logically, have flaps 53A and 53B to fold over the top of the main brace, while avoiding the handle structure, and to be secured on the other side. The overlapping flaps are necessary to increase the effective width of the material, since it must be able to accomodate a variable load of stands.

The inside surfaces of the flaps 53 A & B may include a "velcro" type of binding material to secure these flaps to a corresponding type of material on the top surfaces of of the material at 52 A & B. Simple hooks and eyes, of well known types, could also be provided on these surfaces to secure them together to carry a load of stands.

However, with a larger load there may be a gap between 53A and 53B that would leave the center of the trap stand unprotected, and since one of the objects of the species of the device is to protect the equipment from the weather, as well as from physical damage, a central covering flap 54 is provided to effectively cover the gap.

Figure 7:
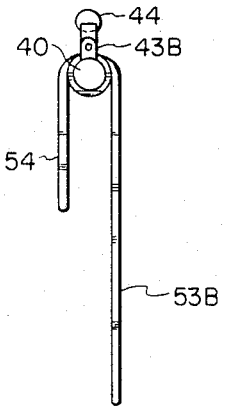
FIG. 7 is an end view of the same species.

FIG. 7 shown an end view of the species of FIG. 6 with the cloth-like material draped from the main brace 40. This shows the side flap 53B and the center flap 54, as well as the shoulder strap hook 43B and the handle 44.

Figure 8:
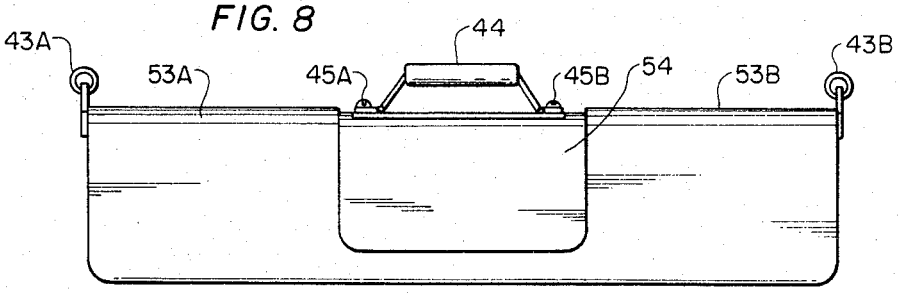
FIG. 8 is a side view of the species of FIG. 7 carrying a load.

FIG. 8 shows the species of FIGS. 6 and 7 wrapped around a typical set of stands, not seen from this angle. Outer flaps 53 A & B extend over the top of the device between the handle structure and the shoulder strap hooks or rings 43 A & B respectively. The center flap 54 covers the space between the outer flaps 53.

Figure 9:
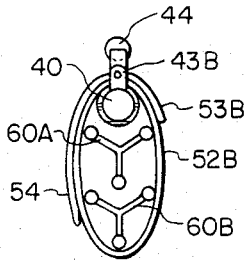
FIG. 9 is an end view of the species of FIG. 8.

FIG. 9 is an end view of the species of FIG. 8 that shows a pair of stands 60 A & B secured and covered by the flap 53B over the material 52B on the main brace 40. The flap 54 covers any gap in the material, and may also be provided with similar fastening means to further secure the load.

In operation, the trap stands are folded in the usual manner to a minimum size, and then positioned on the strap tongues 23, or the material 52, so that the tongues or flaps can be drawn, fairly tightly, around the tops of the main brace to be secured by the buckles, or whatever fastening means is being used. The number of stands that this carrier can accomodate is limited only be the size and weight of the stands, and the length and strength of the straps or material and fastening means. Needless to say, another limitation would be the strength of the bearer.

While a traditional, typical buckle 22 is shown, it is obvious that inumerable, well-known types of buckles or strap fasteners would be equally effective here. Additional straps with corresponding buckles can also be positioned at intermediate points along the main brace, where desired or needed, to make the carrier more secure or stronger.

The material used in the species of FIGS. 6 through 9 could be of any suitable type of cloth, canvas, plastic, or any combination of these. As noted earlier, the material may be secured by strips of "velcro" or the like, or old fashioned hooks and eyes. Additional straps, not shown, could also be provided to strap around over the material for additional strength or security.

The shoulder strap would be an obviously-desireable way of carrying the device, and the strap can be attached to the ends of the device, as shown, or to intermediate points, such as the extension-rod bolts 17 A & B of FIGS. 1 and 2. the shoulder strap is quite conventional, and is omitted from most of the figures for clarity.

I claim:

1. A carrying device for elongated, folded musical instrument stands comprising an elongated main brace; a handle; adjustable, centraly-located means on said elongated main brace for attaching said handle to said main brace; means along said main brace for holding corresponding portions or said stands tightly against said main brace comprising a continuous piece of flexible material extending from one end of said main brace to the other end in length, with one side secured along the top of said main brace; the other side of said flexible material, away from said main brace, including elongated flaps at either end to wrap around said top of said main bace on either side of said handles, and means for securing said elongated flaps on the other sides of said flexible material along the top of said main brace; the width of said material, including said elongated flaps being sufficient to wrap completely around any of said stands being carried by said device.

2. A carrying device for elongated, folded musical instrument stands as in claim 1 wherein said means on said main brace for attaching said handle to said main brace comprises a pair of axial sots along said main brace, on either side of the center of said main brace; and bolts through the ends of said handle and through said axial slots to make said handle moveable along said main brace for balancing a load of said stands.

3. A carrying device for elongated, folded musical instrument stands as in claim 1 having a fastening means at each end of said main brace for attaching the ends of a shoulder strap.

* * * * *